US008900212B2

(12) United States Patent
Kubo

(10) Patent No.: US 8,900,212 B2
(45) Date of Patent: Dec. 2, 2014

(54) CONNECTION DEVICE

(75) Inventor: Tomohiko Kubo, Osaka (JP)

(73) Assignee: Nipro Corporation, Osaka (JP)

( * ) Notice: Subject to any disclaimer, the term of this patent is extended or adjusted under 35 U.S.C. 154(b) by 435 days.

(21) Appl. No.: 13/384,172

(22) PCT Filed: Jul. 12, 2010

(86) PCT No.: PCT/JP2010/061778

§ 371 (c)(1),
(2), (4) Date: Jan. 13, 2012

(87) PCT Pub. No.: WO2011/007760

PCT Pub. Date: Jan. 20, 2011

(65) Prior Publication Data

US 2012/0123382 A1 May 17, 2012

(30) Foreign Application Priority Data

Jul. 15, 2009 (JP) ..... 2009-166867

(51) Int. Cl.
*A61B 19/00* (2006.01)
*A61J 1/20* (2006.01)

(52) U.S. Cl.
CPC ..... *A61J 1/2096* (2013.01); *A61J 2001/2051* (2013.01); *A61J 2001/2013* (2013.01); *A61J 2001/2075* (2013.01); *A61J 2001/2027* (2013.01); *A61J 2001/2082* (2013.01)
USPC ..... 604/413; 604/403; 604/414

(58) Field of Classification Search
CPC ..... A61J 3/00; A61J 1/20; A61J 1/2089; A61J 1/2096; A61J 2001/20; A61J 2001/2013; A61J 2001/2082; A61J 2001/2051; A61J 2001/2075; A61J 2001/2027; A61J 2001/2065; A61J 2001/202; A61J 2001/2003; A61M 5/24
USPC ..... 604/413, 414
See application file for complete search history.

(56) References Cited

U.S. PATENT DOCUMENTS

| | | | | |
|---|---|---|---|---|
| 5,445,631 | A * | 8/1995 | Uchida | 604/412 |
| 5,879,345 | A | 3/1999 | Aneas | |
| 2003/0069538 | A1 | 4/2003 | Pfeifer et al. | |
| 2007/0088315 | A1 | 4/2007 | Haindl | |
| 2008/0300536 | A1 | 12/2008 | Wang et al. | |
| 2008/0300570 | A1 * | 12/2008 | Fowles et al. | 604/410 |

FOREIGN PATENT DOCUMENTS

| | | |
|---|---|---|
| CN | 1196023 A | 10/1998 |
| CN | 2922923 Y | 7/2007 |
| JP | 8-173506 | 7/1996 |
| JP | 2001-112850 | 4/2001 |
| JP | 2007-525264 | 9/2007 |
| JP | 2007-260162 | 10/2007 |
| JP | 2008-523851 | 7/2008 |

OTHER PUBLICATIONS

Chinese Office Action issued in Application No. 201080032641.5 dated May 29, 2013 and English Translation.

* cited by examiner

*Primary Examiner* — Leslie Deak
*Assistant Examiner* — Kai Weng
(74) *Attorney, Agent, or Firm* — McDermott Will & Emery LLP

(57) ABSTRACT

A connection device includes a main holder including a syringe holder to be attached to a syringe and a cannula holder which includes a double-head cannula. The cannula holder is located at a retracted position retracted with respect to the syringe holder in the pre-use state, and is advanced to an advanced position abutting on the syringe holder in the use state. The connection device further includes a separation preventing mechanism which engages the syringe to prevent separation of the syringe from the syringe holder in the state where the cannula holder is located at the retracted position. When the cannula holder is located at the advanced position, the separation preventing mechanism releases an engagement state with the syringe to permit the separation of the syringe from the syringe holder.

16 Claims, 8 Drawing Sheets

CONNECTION DEVICE

RELATED APPLICATIONS

This application is the U.S. National Phase under 35 U.S.C. §371 of International Application No. PCT/JP2010/061778, filed on Jul. 12, 2010, which in turn claims the benefit of Japanese Application No. 2009-166867, filed on Jul. 15, 2009, the disclosures of which Applications are incorporated by reference herein.

TECHNICAL FIELD

The present invention relates to a connection device, and specifically to a connection device capable of switching from a pre-use state in which a syringe and a vial are spaced from each other and a double-head cannula does not penetrate lid members of the syringe and the vial, to a use state in which the syringe and the vial are brought close to each other and the double-head cannula penetrates the lid members.

BACKGROUND ART

A connection device switching from a pre-use state in which a syringe and a vial are spaced from each other and the double-head cannula does not penetrate lid members of the syringe and the vial, to a use state in which the syringe and the vial are brought close to each other and the double-head cannula penetrates the lid members of the syringe and the vial to establish communication between internal spaces of the syringe and the vial is conventionally known.

As such a connection device, a connection device in which the syringe and the vial are connected to both ends of cylindrical holding means and the double-head cannula is provided inside the holding means to be movable (PTL 1).

According to the connection device, by bringing the syringe close to the vial held by the holding means, the double-head cannula can penetrate lid members of the syringe and the vial to establish communication between internal spaces thereof.

CITATION LIST

Patent Literature

PTL 1: Japanese Patent Laying-Open No. 2007-260162

SUMMARY OF INVENTION

Technical Problem

However, the connection device in PTL 1 is configured such that the holding means and the syringe are merely provided to be slidable, and the syringe can be separated from the holding means at any time.

Therefore, there is a possibility that a user may erroneously separate the syringe from the holding means without establishing communication between the syringe and the vial, and use the syringe without mixing a solution inside the syringe with a medicament inside the vial.

In view of such a problem, one object of the present invention is to provide a connection device preventing an operation of establishing communication between the syringe and the vial from being forgotten by error.

Solution to Problem

Specifically, a connection device according to claim 1 is a connection device including holding means spacing a syringe and a vial from each other or bringing the syringe and the vial close to each other, and a double-head cannula provided between lid members attached to the syringe and the vial for penetrating the lid members, the connection device switching from a pre-use state in which the holding means spaces the syringe and the vial from each other and the double-head cannula does not penetrate the lid members of the syringe and the vial, to a use state in which the holding means brings the syringe and the vial close to each other and the double-head cannula penetrates the lid members of the syringe and the vial to establish communication between internal spaces of the syringe and the vial, wherein the holding means is composed of a syringe holding member to be attached to the syringe, and a cannula holding member which includes the double-head cannula, is located at a retracted position retracted with respect to the syringe holding member in the pre-use state, and is advanced to an advanced position abutting on the syringe holding member in the use state, separation preventing means which engages the syringe to prevent separation of the syringe from the syringe holding member in the state where the cannula holding member is located at the retracted position is further provided, and, when the cannula holding member is located at the advanced position, the separation preventing means releases an engagement state with the syringe to permit the separation of the syringe from the syringe holding member.

Advantageous Effects of Invention

According to the invention described above, since the separation preventing means prevents the syringe from being separated from the syringe holding member in the pre-use state, the connection device can prevent a user from forgetting to perform an operation of establishing communication between the syringe and the vial.

DESCRIPTION OF EMBODIMENTS

Figure 1:
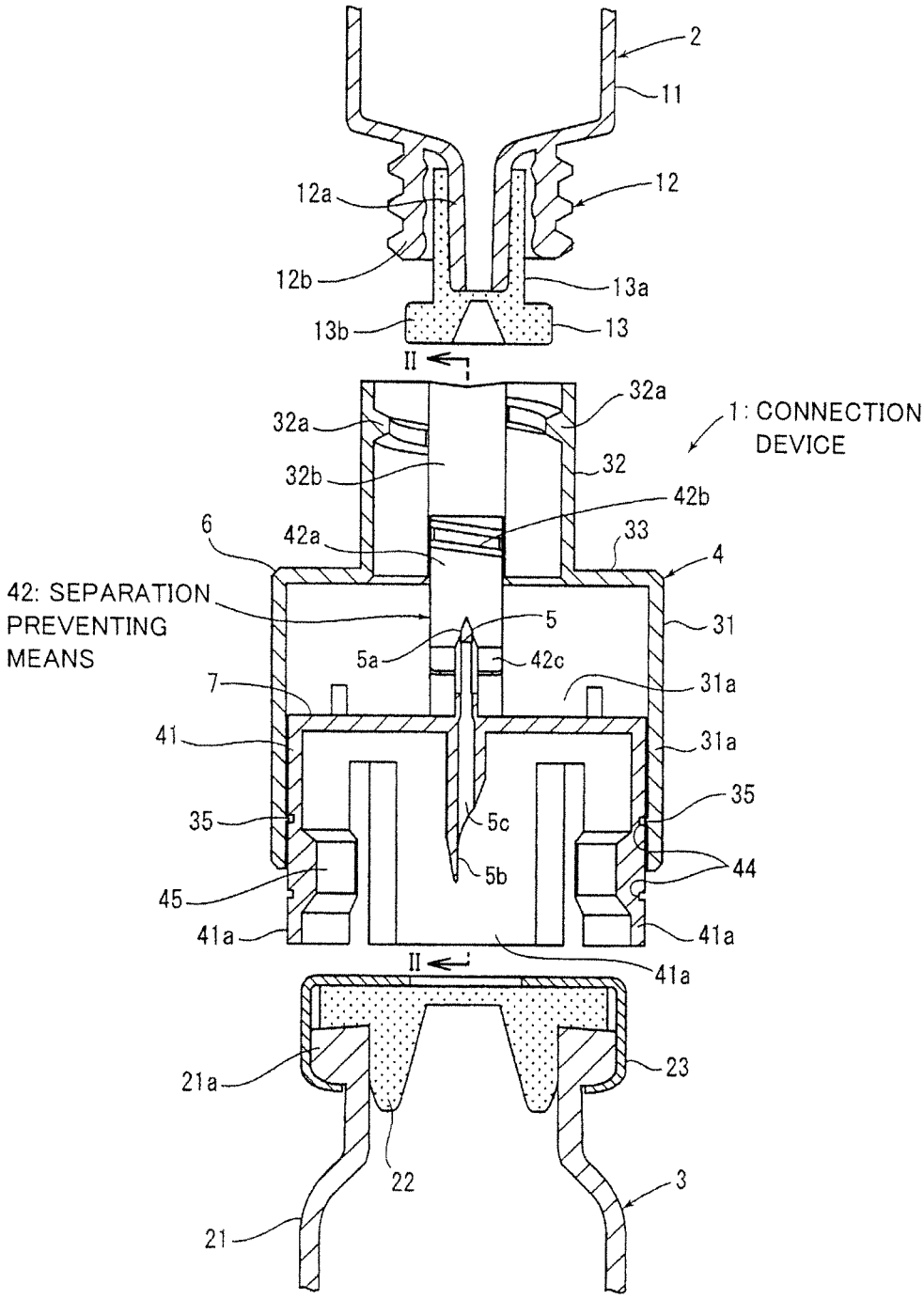
FIG. 1 is a cross sectional view of a connection device in accordance with the present embodiment.
Figure 2:
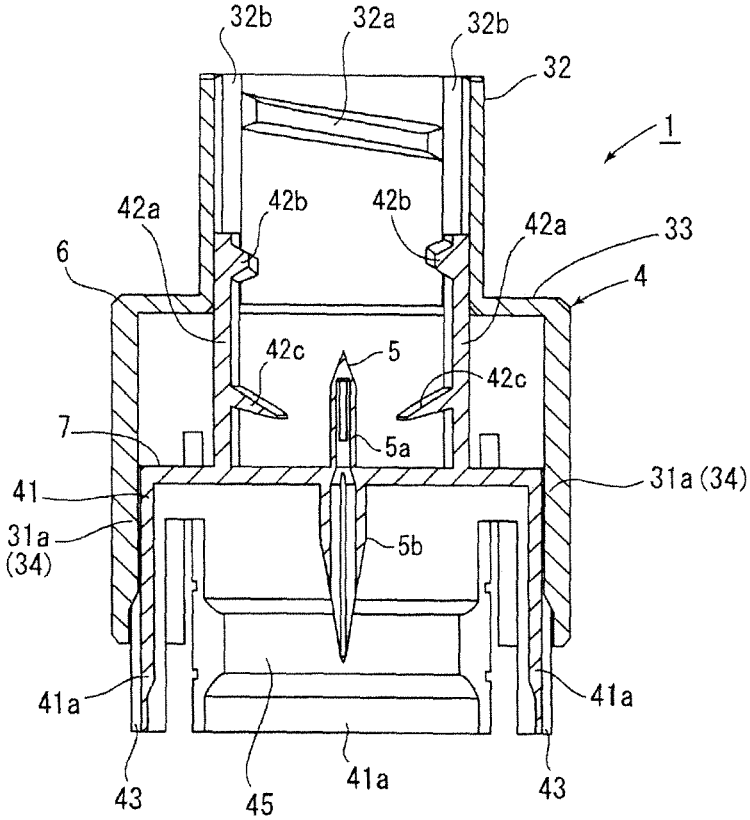
FIG. 2 is a cross sectional view taken along a portion II-II in FIG. 1.
Figure 3:
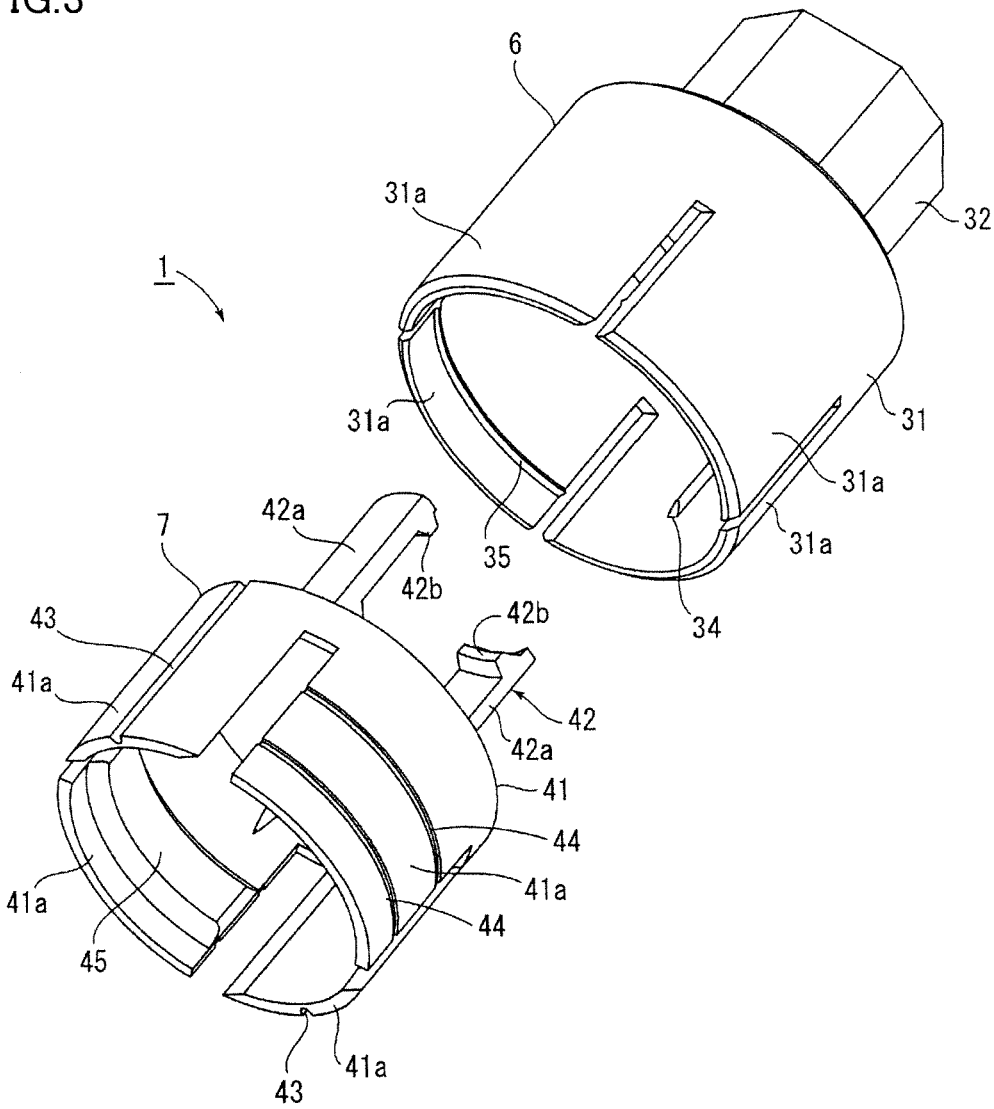
FIG. 3 is a perspective view of the connection device.

Hereinafter, a connection device 1 in accordance with a first embodiment will be described. FIGS. 1 and 2 show cross sectional views of connection device 1 in accordance with the first embodiment, FIG. 3 shows a perspective view of connection device 1, and FIGS. 4 and 5 are views illustrating a method of using connection device 1 in the cross sectional views shown in FIGS. 1 and 2, respectively.

Connection device 1 includes holding means 4 holding a syringe 2 and a vial 3, and a double-head cannula 5 provided between syringe 2 and vial 3 for establishing communication between internal spaces of syringe 2 and vial 3.

Holding means 4 is composed of a syringe holding member 6 to be attached to syringe 2, and a cannula holding member 7 including double-head cannula 5. Syringe holding member 6 and cannula holding member 7 are provided to be capable of being advanced and retracted (i.e., moving forward and backward) in an up-down direction in FIG. 1.

Figure 4:
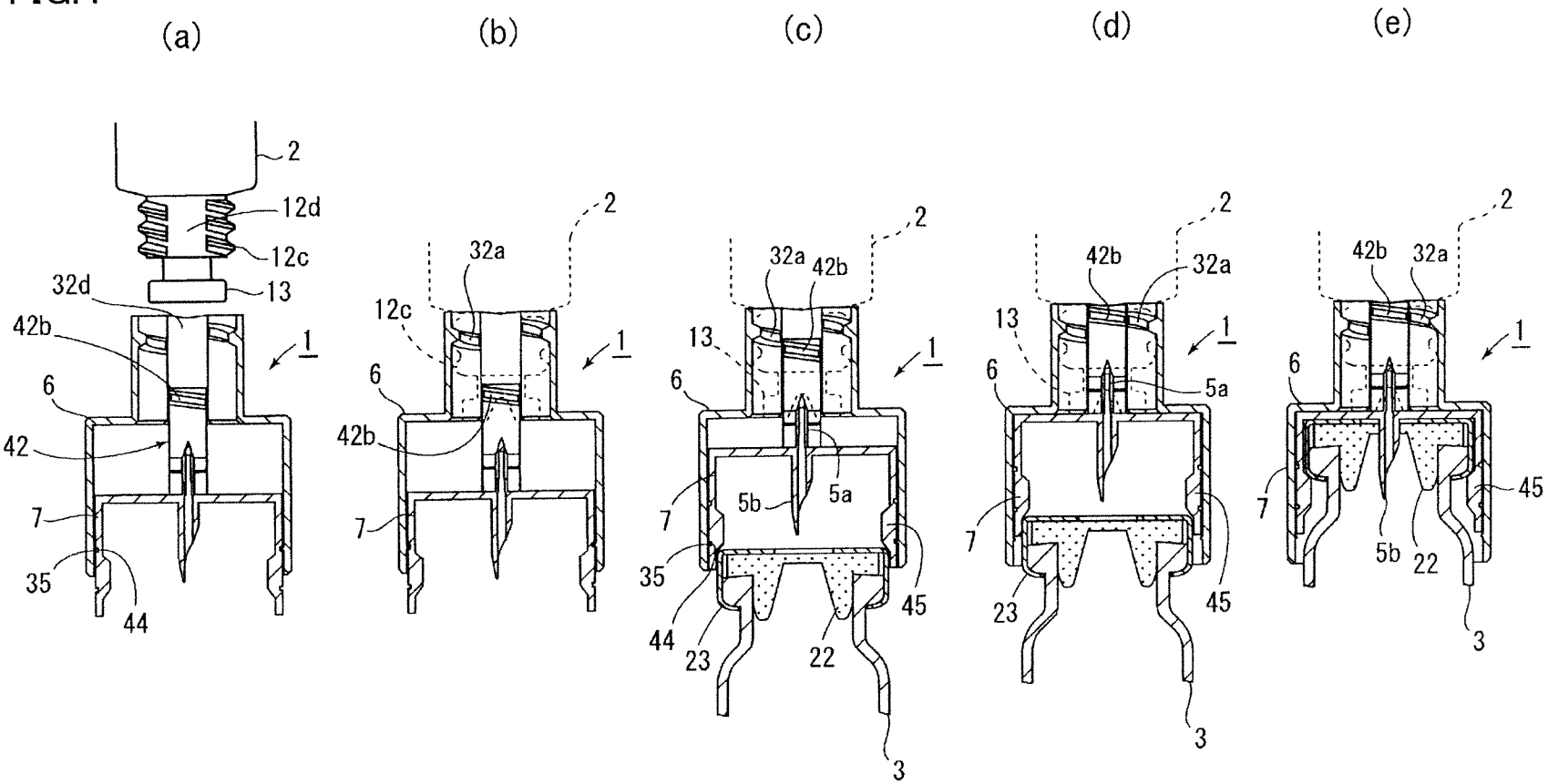
FIG. 4 is a view showing operation of the connection device.
Figure 5:
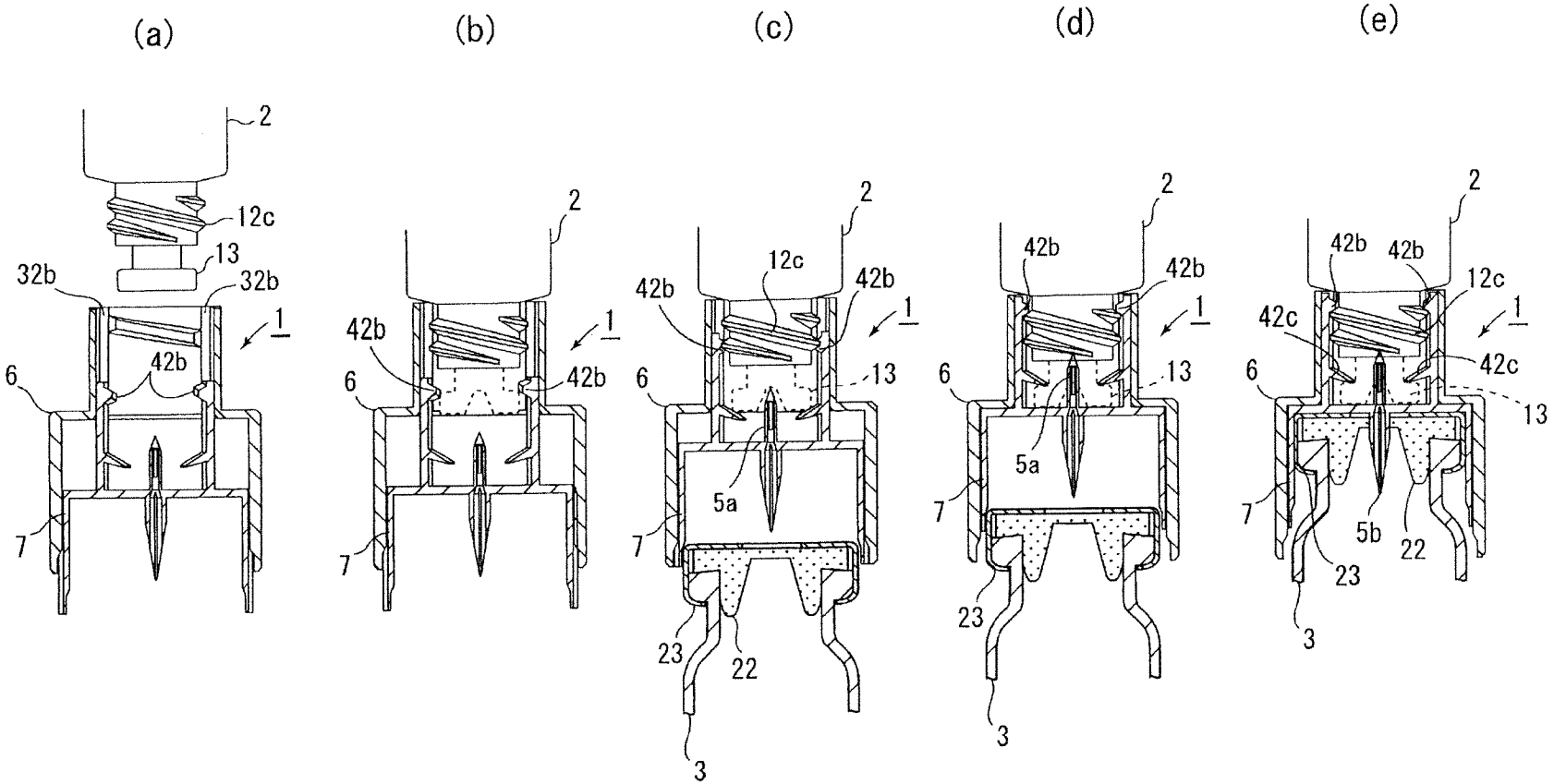
FIG. 5 is a view showing the operation of the connection device viewed in a direction different from that in FIG. 4.

According to connection device 1 having such a configuration, in an attachment state shown in FIGS. 4(*b*) and 5(*b*), cannula holding member 7 is located at a second retracted position located backward with respect to syringe holding member 6.

Next, in a pre-use state shown in FIGS. 4(*c*) and 5(*c*), cannula holding member 7 is located at a first retracted position advanced from the second retracted position, and double-head cannula 5 is located not to establish communication between the internal spaces of syringe 2 and vial 3.

Then, in a use state shown in FIGS. 4(*e*) and 5(*e*), cannula holding member 7 moves to an advanced position in contact with syringe holding member 6, and double-head cannula 5 is located to establish communication between the internal spaces of syringe 2 and vial 3.

It is to be noted that, in the following description, an "axial direction" refers to a direction parallel to a central axis of syringe 2, "forward" refers to an upward direction in FIG. 1, that is, a direction in which vial 3 comes close to syringe 2, and "backward" refers to a downward direction in FIG. 1, that is, a direction in which vial 3 is spaced from syringe 2.

Syringe 2 is composed of a barrel 11 storing a solution, and a plunger not shown advanced and retracted inside barrel 11. A connection portion 12 to which a cannula not shown will be attached is provided at a tip end of barrel 11.

Connection portion 12 is composed of a hollow tapered portion 12*a* in communication with the inside of barrel 11, and a cylindrical portion 12*b* provided to surround tapered portion 12*a*. An external thread portion 12*c* is formed on an outer periphery of cylindrical portion 12*b*.

In addition, grooves 12*d* are formed in external thread portion 12*c* in a forward-backward direction, at opposite positions with the central axis being sandwiched therebetween. Thereby, external thread portion 12*c* is interrupted and discontinuous (FIG. 4(*a*)).

Further, a rubber lid member 13 is attached to tapered portion 12*a*. Lid member 13 is composed of a small diameter portion 13*a* which covers tapered portion 12*a* and has a diameter smaller than that of cylindrical portion 12*b*, and a large diameter portion 13*b* with a large diameter provided at a tip end of small diameter portion 13*a*. Large diameter portion 13*b* has a thin center.

Vial 3 is composed of a glass bottle portion 21 storing a medicament, a rubber lid member 22 attached to an opening of bottle portion 21, and a metal ring member 23 fixing lid member 22 to bottle portion 21.

A flange portion 21*a* having a diameter substantially identical to that of lid member 22 is formed at the opening of bottle portion 21, and lid member 22 is formed to have a thin center. Ring member 23 surrounds flange portion 21*a* and lid member 22 to fasten them integrally, such that a thin portion of lid member 22 is exposed.

Syringe holding member 6 is composed of an outer cylindrical portion 31 in the shape of a cylinder provided to cover cannula holding member 7, and an attachment portion 32 which has a diameter smaller than that of outer cylindrical portion 31 and is to be connected with connection portion 12 of syringe 2. A step difference portion 33 is formed between outer cylindrical portion 31 and attachment portion 32. Outer cylindrical portion 31 includes four flaps 31*a* made by four slits formed in the forward-backward direction. Guide protrusions 34 are formed on a pair of facing flaps 31*a* in the forward-backward direction, and stopper protrusions 35 are formed in an arc shape in the vicinities of back end portions of another pair of facing flaps 31*a*.

An inner peripheral surface of attachment portion 32 has a diameter substantially identical to that of an outer peripheral surface of cylindrical portion 12*b* of syringe 2. An internal thread portion 32*a* into which external thread portion 12*c* formed in cylindrical portion 12*b* is to be screwed is formed in the inner peripheral surface of attachment portion 32.

Further, grooves 32*b* are formed in internal thread portion 32*a* in the forward-backward direction, at opposite positions with the central axis being sandwiched therebetween. Thereby, internal thread portion 32*a* is interrupted and discontinuous.

Grooves 12*d* in external thread portion 12*c* formed in syringe 2 and grooves 32*b* in internal thread portion 32*a* are formed to have an identical width, and provided such that grooves 12*d* and 32*b* will overlap when external thread portion 12*c* is screwed into internal thread portion 32*a*.

Cannula holding member 7 includes an inner cylindrical portion 41 in the shape of a bottomed cylinder having double-head cannula 5 provided at the center, and separation preventing means 42 preventing separation of syringe 2 from syringe holding member 6 in the pre-use state.

Double-head cannula S is composed of a syringe-side cannula 5*a* closer to syringe 2, and a vial-side cannula 5*b* closer to vial 3. A channel 5*c* is formed inside syringe-side cannula 5*a* and vial-side cannula 5*b*.

A tip end of syringe-side cannula 5*a* is formed into a conical shape, and channel 5*c* is opened at side surfaces of syringe-side cannula 5*a*. On the other hand, a tip end of vial-side cannula 5*b* is formed obliquely as shown in FIG. 1, and channel 5*c* is opened behind a sharp tip end portion.

Further, syringe-side cannula 5*a* is finer than vial-side cannula 5*b*, and puncture resistance obtained when syringe-side cannula 5*a* penetrates lid member 13 of syringe 2 is smaller than puncture resistance obtained when vial-side cannula 5*b* penetrates lid member 22 of vial 3.

Inner cylindrical portion 41 has an outer diameter substantially identical to an inner diameter of outer cylindrical portion 31 of syringe holding member 6, and has an inner diameter substantially identical to an outer diameter of flange portion 21*a* of vial 3.

In addition, four flaps 41*a* are formed in inner cylindrical portion 41, at positions identical to those in outer cylindrical portion 31. In each flap 41*a* corresponding to flap 31*a* having guide protrusion 34 formed thereon in outer cylindrical portion 31, a guide groove 43 in which guide protrusion 34 will engage is formed in an outer peripheral surface thereof.

By engaging guide protrusions 34 in guide grooves 43, rotation of syringe holding member 6 and cannula holding member 7 is restricted, and their advanced and retracted movement in the forward-backward direction is permitted.

On the other hand, in each flap 41*a* corresponding to flap 31*a* having stopper protrusion 35 formed thereon in outer cylindrical portion 31, stopper grooves 44 in which stopper protrusion 35 will engage are formed in an outer peripheral surface thereof, at two positions in the forward-backward direction, and a holding protrusion 45 holding vial 3 is formed on an inner peripheral surface thereof.

Stopper grooves 44 are formed at positions where stopper protrusion 35 engages them respectively when cannula holding member 7 is located at the second retracted position and the first retracted position with respect to syringe holding member 6.

In the pre-use state shown in FIGS. 4(*c*) and 5(*c*), holding protrusions 45 abut on an end surface of vial 3 on a side closer to syringe 2, such that double-head cannula 5 is located at a position where it does not penetrate lid member 22 of vial 3.

On the other hand, when vial 3 is relatively advanced with respect to the pre-use state, ring member 23 of vial 3 pushes holding protrusions 45 outward, and thereafter is held between a bottom portion of inner cylindrical portion 41 and holding protrusions 45, and in the meantime double-head cannula 5 penetrates lid member 22 of vial 3, entering the post-use state shown in FIGS. 4(*e*) and 5(*e*).

Separation preventing means 42 is composed of two insertion pieces 42*a* provided at opposite positions with syringe-side cannula 5*a* in inner cylindrical portion 41 being sandwiched therebetween, partial thread portions 42*b* provided on inner sides of tip ends of insertion pieces 42*a*, and stopper members 42*c* provided closer to inner cylindrical portion 41 than partial thread portions 42*b*.

Insertion pieces 42*a* are formed at positions and formed to have a width which allow insertion pieces 42*a* to slide along grooves 32*b* formed in internal thread portion 32*a* in attachment portion 32 of syringe holding member 6. Insertion pieces 42*a* have inner surfaces with a diameter identical to that of the inner peripheral surface of attachment portion 32.

Partial thread portions 42*b* have a shape that continues to internal thread portion 32*a*. When partial thread portions 42*b* are aligned with internal thread portion 32*a* as shown in FIG. 4(*e*), internal thread portion 32*a* interrupted by grooves 32*b* are smoothly connected by partial thread portions 42*b*.

Stopper members 42*c* are elastically deformable, thin plate-like members, and are provided at positions where stopper members 42*c* engage lid member 13 of syringe 2 from a side closer to syringe 2 in the post-use state.

Hereinafter, a method of using connection device 1 having the above configuration will be described with reference to the drawings in FIGS. 4 and 5.

Firstly, FIGS. 4(*a*) and 5(*a*) show an assembly state of connection device 1. On this occasion, syringe 2 and vial 3 are not connected to connection device 1.

Here, an operation of inserting inner cylindrical portion 41 of cannula holding member 7 into outer cylindrical portion 31 of syringe holding member 6 and stopping cannula holding member 7 at the second retracted position is performed.

Specifically, the positions of guide protrusions 34 formed on an inner peripheral surface of outer cylindrical portion 31 are caused to engage guide grooves 43 formed in an outer peripheral surface of inner cylindrical portion 41, and cannula holding member 7 is inserted into syringe holding member 6.

Then, stopper protrusions 35 formed on the inner peripheral surface of outer cylindrical portion 31 engage stopper grooves 44 located closer to syringe 2, of stopper grooves 44 formed in the outer peripheral surface of inner cylindrical portion 41. Thereby, cannula holding member 7 is stopped at the second retracted position.

On the other hand, when cannula holding member 7 is inserted to the second retracted position, insertion pieces 42*a* of separation preventing means 42 are inserted into grooves 32*b* in attachment portion 32 of syringe holding member 6, and partial thread portions 42*b* are located backward of internal thread portion 32*a*.

Next, FIGS. 4(*b*) and 5(*b*) show the attachment state in which syringe 2 is connected to connection device 1. This operation is performed by a medicament manufacturer or the like, and an operation by a medical worker is not required.

Here, an operation of screwing external thread portion 12*c* formed in connection portion 12 of syringe 2 into internal thread portion 32*a* in attachment portion 32 of syringe holding member 6 is performed.

As a result, when external thread portion 12*c* is fully screwed into internal thread portion 32*a*, grooves 12*d* formed in external thread portion 12*c* overlap grooves 32*b* formed in internal thread portion 32*a*.

On the other hand, since partial thread portions 42*b* of separation preventing means 42 are located backward of internal thread portion 32*a*, partial thread portions 42*b* do not interfere with external thread portion 12*c* of syringe 2, and do not prevent screwing of syringe 2 into syringe holding member 6.

Next, FIGS. 4(*c*) and 5(*c*) show the pre-use state in which connection device 1 having syringe 2 connected thereto is set on vial 3. Connection device 1 in the pre-use state is provided to a medical setting.

To shift from the attachment state to the pre-use state, it is only necessary to advance cannula holding member 7 from the second retracted position to the first retracted position with respect to syringe holding member 6, and cause vial 3 to abut on holding protrusions 45 of cannula holding member 7.

When cannula holding member 7 is advanced to the first retracted position, syringe-side cannula 5*a* of double-head cannula 5 is advanced to a position where it does not penetrate lid member 13 of syringe 2, and partial thread portions 42*b* of separation preventing means 42 are stopped at positions misaligned with respect to internal thread portion 32*a*.

As a result, if an attempt is made to rotate syringe 2 and syringe holding member 6 in the pre-use state, external thread portion 12*c* of syringe 2 interferes with partial thread portions 42*b*. Thus, rotation of syringe 2 and syringe holding member 6 is prevented, and syringe 2 cannot be separated from syringe holding member 6.

Next, FIGS. 4(*d*) and 5(*d*) show a syringe-side penetrated state in which syringe 2 and vial 3 are brought close to each other and syringe-side cannula 5*a* penetrates lid member 13 of syringe 2.

It is to be noted that actual operation can proceed from the pre-use state in FIGS. 4(*c*) and 5(*c*) to the use state in FIGS. 4(*e*) and 5(*e*) without stopping, and does not have to be stopped in the state in FIGS. 4(*d*) and 5(*d*).

When syringe 2 and vial 3 are brought close to each other, cannula holding member 7 is pressed by vial 3 and attempts to move to the advanced position, and vial 3 attempts to pass over holding protrusions 45 of cannula holding member 7 and move forward.

Here, since syringe-side cannula 5*a* is finer and has a smaller puncture resistance than vial-side cannula 5*b*, and resistive force that allows vial 3 to pass over holding protrusions 45 is required, cannula holding member 7 firstly moves to the advanced position with respect to syringe holding member 6, and syringe-side cannula 5*a* penetrates lid member 13 of syringe 2.

It is to be noted that, on this occasion, vial-side cannula 5*b* may penetrate lid member 22 before syringe-side cannula 5*a* penetrates lid member 13 of syringe 2.

Subsequently, FIGS. 4(*e*) and 5(*e*) show the use state in which syringe 2 and vial 3 are further brought close to each other from the syringe-side penetrated state and communication is established between the internal spaces of syringe 2 and vial 3.

When vial 3 is further advanced from the syringe-side penetrated state in FIGS. 4(*d*) and 5(*d*), vial 3 presses holding protrusions 45 outward, and thereby flaps 31*a* of cannula holding member 7 and flaps 41*a* of syringe holding member 6 are integrally deformed to permit passage of vial 3.

Then, ring member 23 of vial 3 passes over holding protrusions 45 and abuts on the bottom portion of inner cylindrical portion 41. Thus, vial 3 is held by holding protrusions 45 so as not to detached from cannula holding member 7, and lower ends of flaps 41*a* engage stopper protrusions 35 to prevent retraction of cannula holding member 7.

On the other hand, as vial 3 is advanced, vial-side cannula 5*b* of double-head cannula 5 penetrates lid member 22 of vial 3, and thereby communication is established between the internal space of syringe 2 and the internal space of vial 3.

Here, since double-head cannula 5 penetrates lid member 13 on the syringe 2 side beforehand and penetrates lid member 22 of vial 3 thereafter, the solution inside syringe 2 can be drawn into vial 3 having a negative pressure.

After entering the use state, a user performs an operation of operating syringe 2 to inject the solution into vial 3 to dissolve the medicament inside vial 3 with the solution, and then drawing the dissolved medicament again into syringe 2.

After the user draws the medicament mixed as described above into syringe 2, the user can separate syringe 2 from connection device 1, attach a cannula for puncture to the syringe, and administer the medicament to a patient using syringe 2.

When syringe 2 is separated from connection device 1, cannula holding member 7 is located at the advanced position, and partial thread portions 42*b* of separation preventing means 42 are continuous with internal thread portion 32*a* of syringe holding member 6.

As a result, partial thread portions 42*b* do not interfere with external thread portion 12*c* of syringe 2, and thereby rotation of syringe 2 and syringe holding member 6 can be permitted, and syringe 2 can be separated.

On the other hand, when cannula holding member 7 is located at the advanced position, stopper members 42*c* pass over large diameter portion 13*b* of lid member 13 in syringe 2 while being deformed, and engage large diameter portion 13*b* from the side close to syringe 2.

As a result, when syringe 2 is separated from syringe holding member 6, lid member 13 can be removed from syringe 2, with engagement thereof with syringe holding member 6 being maintained by stopper members 42*c*.

As described above, according to connection device 1 of the first embodiment, since partial thread portions 42*b* of separation preventing means 42 engage external thread portion 12*c* of syringe 2 in the pre-use state, syringe 2 cannot be removed from connection device 1.

Thereafter, when communication is established between the internal spaces of syringe 2 and vial 3 as the use state, partial thread portions 42*b* are aligned with internal thread portion 32*a* of syringe holding member 6 to permit rotation of external thread portion 12*c*, and thus syringe 2 can be separated from connection device 1.

That is, according to connection device 1 of the first embodiment, connection device 1 is designed such that syringe 2 cannot be separated in a state where no communication is established between syringe 2 and vial 3. Therefore, connection device 1 can prevent an error by the user, and prevent the user from forgetting to perform an operation of establishing communication between syringe 2 and vial 3.

Figure 6:
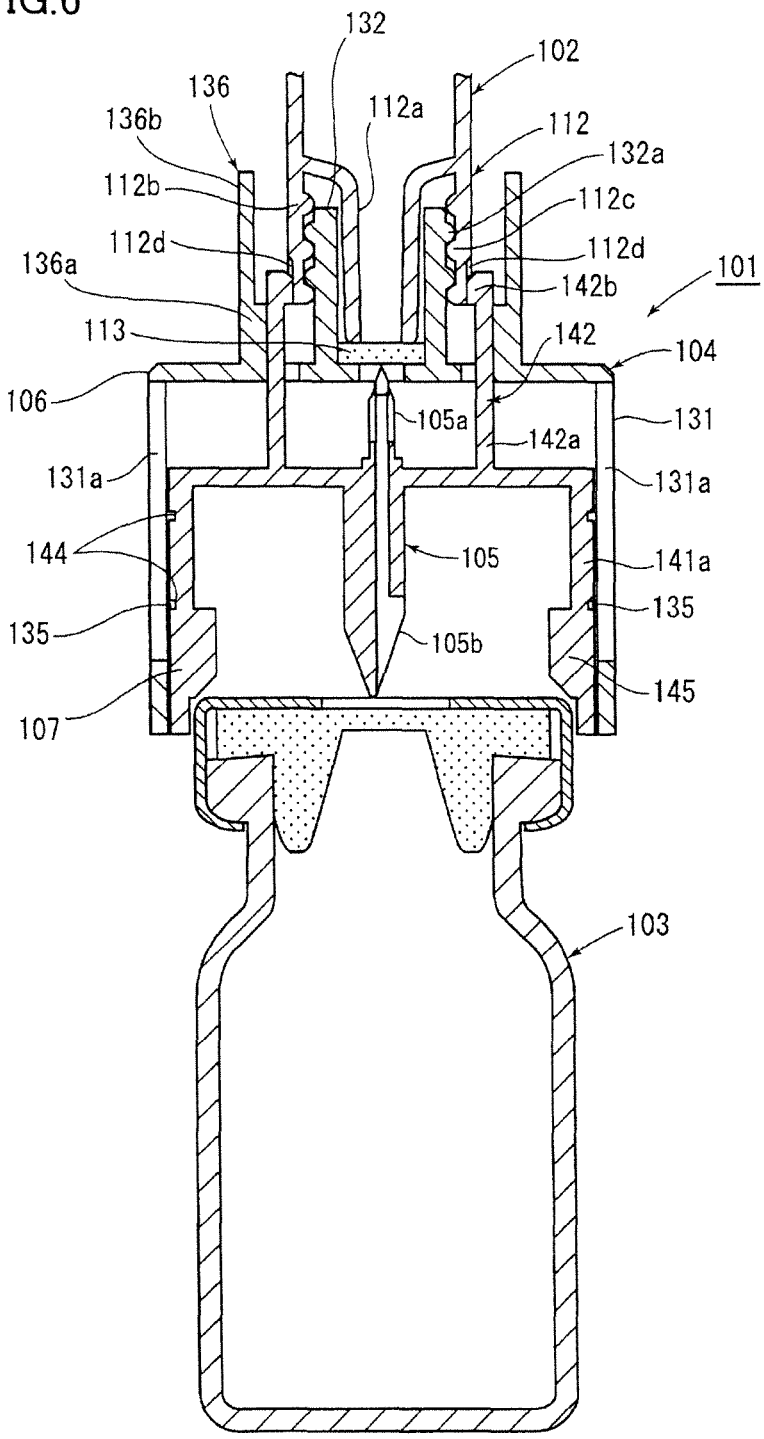
FIG. 6 is a cross sectional view of a connection device in accordance with a second embodiment.
Figure 7:
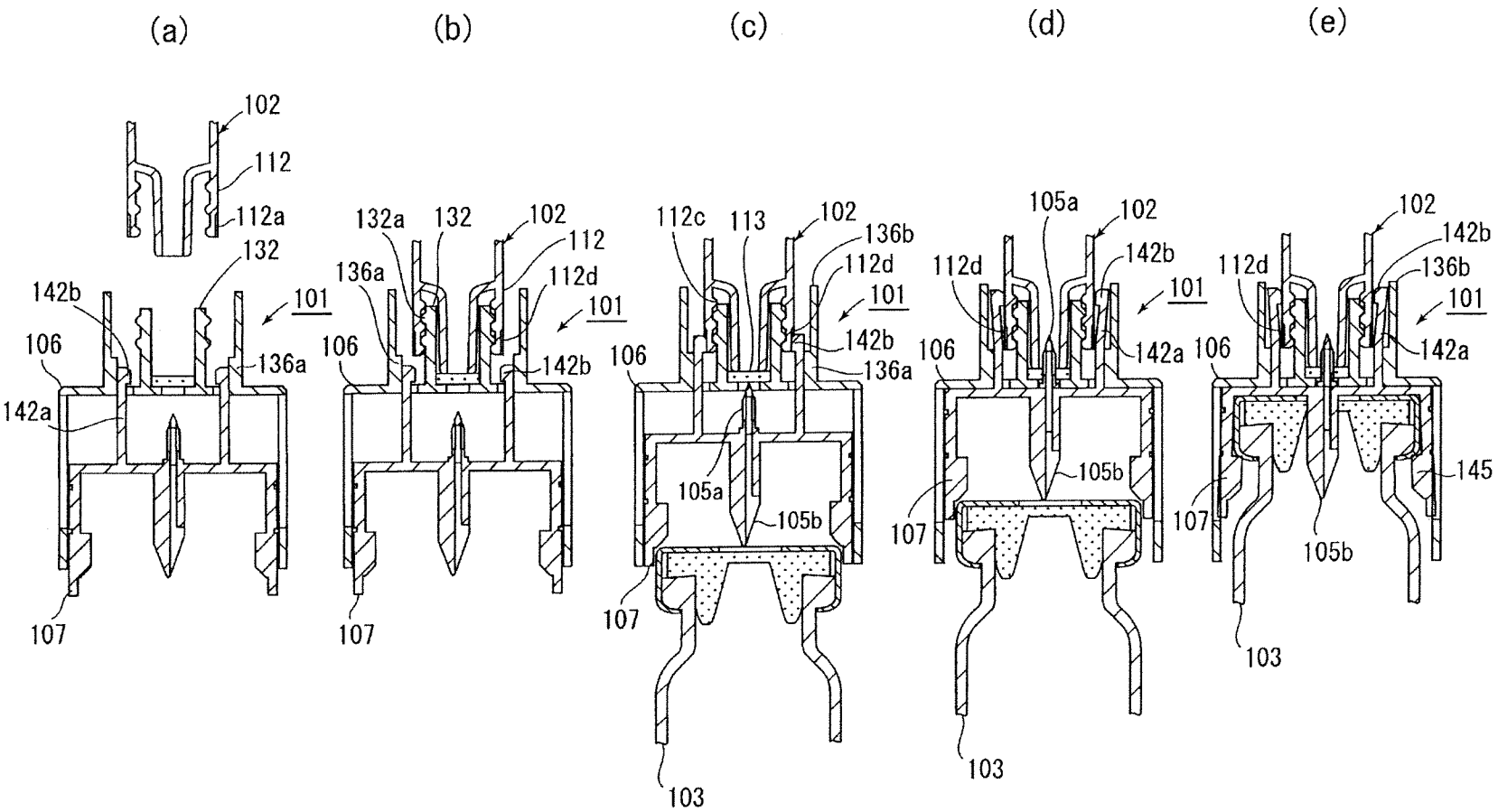
FIG. 7 is a view showing operation of the connection device in accordance with the second embodiment.

Next, a connection device 101 in accordance with a second embodiment will be described. FIG. 6 shows a cross sectional view of connection device 101 in accordance with the second embodiment, and FIG. 7 is a view illustrating a method of using connection device 101.

In the following description, parts common to those in the first embodiment will not be repeatedly described, and identical members will be designated by numerals given by adding 100 to the numerals used in the first embodiment.

A connection portion 112 of a syringe 102 is composed of a hollow tapered portion 112*a* in communication with the inside of a barrel not shown, and a cylindrical portion 112*b* provided to surround tapered portion 112*a*. An internal thread portion 112*c* is formed in an inner periphery of cylindrical portion 112*b*.

In addition, engagement grooves 112*d* are formed in an outer peripheral surface of cylindrical portion 112*b* in the forward-backward direction, at opposite positions with the central axis being sandwiched therebetween. Engagement grooves 112*d* are formed to be opened at an end portion of cylindrical portion 112*b*.

Further, a rubber, thin plate-like lid member 113 is attached to a tip end of tapered portion 112*a*, and is sandwiched between the tip end and a syringe holding member 106.

Holding means 104 is composed of syringe holding member 106 to be attached to syringe 102, and a cannula holding member 107 including double-head cannula 105. Syringe holding member 106 and cannula holding member 107 are provided to be capable of being advanced and retracted.

Penetration holes 131*a* are formed at opposite positions in an outer cylindrical portion 131 of syringe holding member 106. Further, in an inner peripheral surface of outer cylindrical portion 131, stopper protrusions 135 in an arc shape are formed, and guide protrusions 134 not shown are formed in the forward-backward direction.

Attachment portion 132 is formed in the shape of a cylinder, its outer peripheral surface has a diameter substantially identical to that of an inner peripheral surface of cylindrical portion 112*b* in connection portion 112 of syringe 102, and its inner peripheral surface has a diameter larger than that of tapered portion 112*a*.

Further, an external thread portion 132*a* which is to be screwed into internal thread portion 112*c* formed in cylindrical portion 112*b* is formed in the outer peripheral surface of attachment portion 132.

In addition, a cylindrical support portion 136 formed to have a diameter larger than that of cylindrical portion 112*b* of syringe 102 is formed further outside of attachment portion 132. Support portion 136 has a backward portion formed as a thick portion 136*a*, and a forward portion formed as a thin portion 136*b*.

Thick portion 136*a* is located such that, when syringe 102 is attached to syringe holding member 106, thick portion 136*a* reaches a position identical to a position where a tip end portion of cylindrical portion 112*b* of syringe 102 reaches. Thereby, a step difference between thick portion 136*a* and thin portion 136*b* is formed in an inner peripheral surface of support portion 136.

In an outer peripheral surface of an inner cylindrical portion 141 in cannula holding member 107, guide grooves not shown in which the guide protrusions of outer cylindrical portion 131 will engage are formed to restrict rotation of syringe holding member 106 and cannula holding member 107.

Further, in the outer peripheral surface of inner cylindrical portion 141, stopper grooves 144 in which each stopper protrusion 135 of outer cylindrical portion 131 will engage are formed at two positions in the forward-backward direction. Stopper grooves 144 allow cannula holding member 107 to stop at a second retracted position and a first retracted position with respect to syringe holding member 106.

Furthermore, in inner cylindrical portion 141, flaps 141*a* are formed to be aligned with the positions of penetration holes 131*a* formed in outer cylindrical portion 131, and holding protrusions 145 which will engage a ring member 123 of vial 103 are formed on inner surfaces of flaps 141*a*.

Separation preventing means 142 is provided to cannula holding member 107, and is composed of two deformation portions 142*a* provided at opposite positions with syringe-side cannula 5*a* being sandwiched therebetween, and engaging protrusions 142*b* provided on inner sides of tip ends of deformation portions 142*a*.

Deformation portions 142*a* are provided to penetrate a bottom portion of syringe holding member 106 and protrude toward attachment portion 132, and are provided to come into contact with an inner peripheral surface of thick portion 136*a* of support portion 136.

In addition, engaging protrusions 142*b* are provided at positions where they engage engagement grooves 112*d* formed in syringe 102 in a pre-use state in which syringe 102 is attached to syringe holding member 106.

Hereinafter, a method of using connection device 101 having the above configuration will be described with reference to the drawings in FIG. 7.

Firstly, FIG. 7(*a*) shows an assembly state of connection device 101, in which cannula holding member 107 is stopped at the second retracted position with respect to syringe holding member 106.

On this occasion, the guide protrusions of outer cylindrical portion 131 are caused to engage the guide grooves in inner cylindrical portion 141, and thus rotation of syringe holding member 106 and cannula holding member 107 is restricted.

On the other hand, when cannula holding member 107 is located at the second retracted position, deformation portions 142*a* of separation preventing means 142 protrude between connection portion 112 of syringe holding member 106 and support portion 136, and stop at positions where portions having engaging protrusions 142*b* formed thereon do not move beyond thick portion 136*a*.

Next, FIG. 7(*b*) shows an attachment state in which syringe 102 is connected to connection device 101, in which external thread portion 132*a* of syringe holding member 106 is screwed into internal thread portion 112*c* of syringe 102.

Thereby, the tip end portion of cylindrical portion 112*b* of syringe 102 is located at a boundary between thin portion 136*b* and thick portion 136*a* of support portion 136, and engagement grooves 112*d* are located at angles at which engaging protrusions 142*b* are located.

On this occasion, engaging protrusions 142*b* are stopped at the position of thick portion 136*a*, and do not engage engagement grooves 112*d*. Therefore, engaging protrusions 142*b* do not prevent rotation of syringe 102.

Next, FIG. 7(*c*) shows the pre-use state, and illustrates a state in which cannula holding member 107 is advanced to the first retracted position, and vial 103 is set to cannula holding member 107.

Thereby, double-head cannula 105 comes close to lid member 113 of syringe 102 to a position where it does not penetrate lid member 113, and engaging protrusions 142*b* of separation preventing means 142 are advanced and engage engagement grooves 112*d* in syringe holding member 106.

Here, rotation of cannula holding member 107 and syringe holding member 106 is restricted by guide protrusions 134 and guide grooves 143, and rotation of syringe 102 and syringe holding member 106 is also restricted. Thus, syringe 102 cannot be separated from syringe holding member 106.

In addition, although engaging protrusions 142*b* are advanced and protrude more forward than thick portion 136*a* of support portion 136, they protrude from thick portion 136*a* only in a small amount. Accordingly, if an attempt is made to rotate syringe 102 and syringe holding member 106, thick portion 136*a* prevents deformation of deformation portions 142*a*, and prevents engaging protrusions 142*b* from being detached from engagement grooves 112*d*.

Further, since vial 103 abuts on holding protrusions 145 of cannula holding member 107 from backward, vial 103 is held in a state where it is close to a vial-side cannula 105*b* of double-head cannula 105.

Next, FIG. 7(*d*) shows a syringe-side penetrated state in which only syringe-side cannula 105*a* of double-head cannula 105 penetrates lid member 113 of syringe 102.

As in the first embodiment, syringe-side cannula 105*a* of the present embodiment is also finer and has a smaller puncture resistance than vial-side cannula 105*b*, and resistive force that allows vial 103 to pass over holding protrusions 145 is required. Accordingly, cannula holding member 107 firstly moves to an advanced position with respect to syringe holding member 106, and syringe-side cannula 105*a* penetrates lid member 113 of syringe 102.

Subsequently, FIG. 7(*e*) shows a use state in which syringe 102 and vial 103 are brought close to each other.

When vial 103 is further advanced from the syringe-side penetrated state in FIG. 7(*d*), vial 103 presses holding protrusions 145 outward, and thereby flaps 141*a* of cannula holding member 107 are deformed while protruding outward from penetration holes 131*a* formed in outer cylindrical portion 131 of syringe holding member 106, to permit passage of vial 103.

Then, vial 103 is advanced and abuts on inner cylindrical portion 141 of cannula holding member 107. Thus, vial 103 is held in cannula holding member 107 by holding protrusions 145.

On the other hand, as vial 103 is advanced, vial-side cannula 105*b* of double-head cannula 105 penetrates lid member 122 of vial 103, and thereby communication is established between an internal space of syringe 102 and an internal space of vial 103.

After entering the use state, a medicament in vial 103 is dissolved with a solution in syringe 102, and the obtained medicament is drawn into syringe 102. Then, syringe 102 can be separated from connection device 101, as in the first embodiment.

Specifically, by positioning cannula holding member 107 at the advanced position as the use state, engaging protrusions 142*b* of separation preventing means 142 move forward of engagement grooves 112*d* in syringe holding member 106, get onto the outer peripheral surface of cylindrical portion 112*b*, and move outward.

On this occasion, since deformation portions 142*a* are advanced from thick portion 136*a* toward thin portion 136*b* of support portion 136, deformation portions 142*a* are deformed in accordance with movement of engaging protrusions 142*b*, and thin portion 136*b* permits the movement of engaging protrusions 142*b* and deformation of deformation portions 142*a*.

Since engaging protrusions 142*b* are separated from engagement grooves 112*d* as described above, syringe 102 can be rotated with respect to syringe holding member 106, and thus syringe 102 can be separated.

As described above, according to connection device 101 of the second embodiment, since engaging protrusions 142*b* of separation preventing means 142 engage engagement grooves 112*d* of syringe 102 in the pre-use state to prevent rotation of syringe 102 and connection device 101, syringe 102 cannot be removed.

Thereafter, when communication is established between the internal spaces of syringe 102 and vial 103 as the use state, engaging protrusions 142*b* are separated from engagement grooves 112*d* to permit rotation of syringe 102 and syringe holding member 106, and thus syringe 102 can be separated from connection device 101.

That is, also in connection device 101 of the second embodiment, connection device 101 is designed such that syringe 102 cannot be used in a state where no communication is established between syringe 102 and vial 103, as in connection device 1 of the first embodiment. Therefore, connection device 101 can prevent an error by a user, and prevent the user from forgetting to perform an operation of establishing communication between syringe 102 and vial 103.

Figure 8:
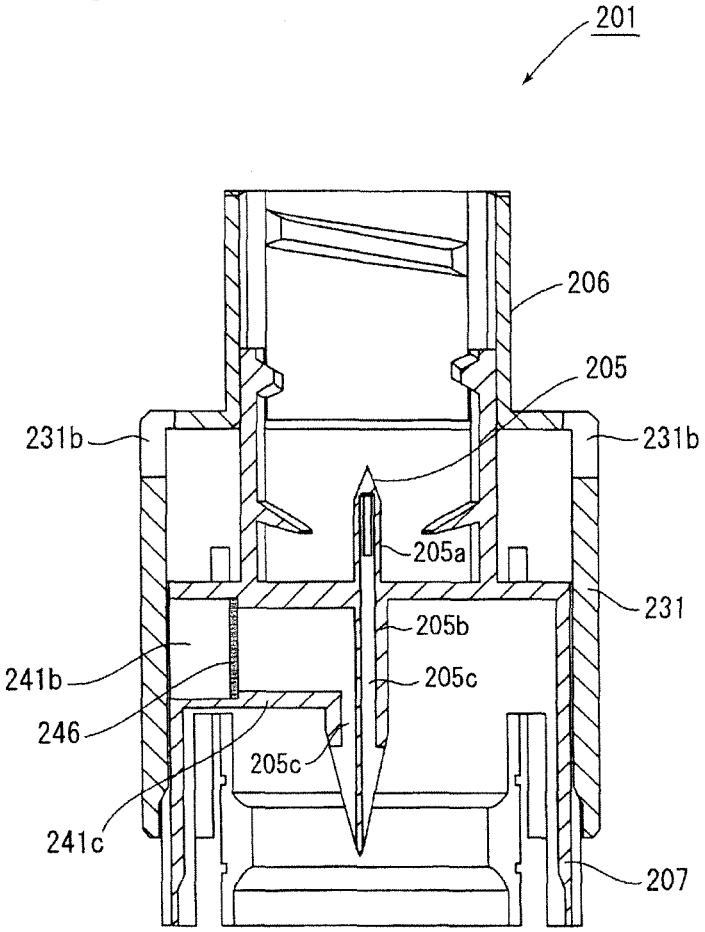
FIG. 8 is a view showing a connection device in accordance with a third embodiment, and operation thereof.

FIG. 8 shows a cross sectional view of a connection device 201 in accordance with a third embodiment, which is suitable for a vial storing a freeze-dried medicament, when compared with connection device 1 of the first embodiment.

In the following description, parts common to those in the first embodiment will not be repeatedly described, and identical members will be designated by numerals given by adding 200 to the numerals used in the first embodiment.

Generally, the inside of a vial storing a freeze-dried medicament is maintained under a vacuum. When connection device 1 of the first embodiment is used to enter the use state shown in FIGS. 4(*e*) and 5(*e*), there occurs a problem that, although the solution inside syringe 2 is drawn into vial 3 by a pressure difference, the pressure difference makes an operation of retracting a plunger heavier when the medicament inside vial 3 is thereafter drawn into syringe 2.

Therefore, connection device 201 of the third embodiment is configured by providing connection device 1 of the first embodiment with a vent 241*b* in a side surface of an inner cylindrical portion 241 of a cannula holding member 207, and a filter 246 provided to vent 241*b*.

Vent 241*b* is formed within a cylindrical housing 241*c* formed from an outer periphery of inner cylindrical portion 241 to a vial-side cannula 205*b*. In the use state, the vial is held in cannula holding member 207 in a state abutting on housing 241*c* from below.

Further, two channels 205*c* are formed inside vial-side cannula 205*b*. One channel 205*c* is in communication with syringe-side cannula 205*a*, and the other channel 205*c* is in communication with vent 241*b*.

In addition, communication holes 231*b* are formed in an outer cylindrical portion 231 of a syringe holding member 206. When cannula holding member 207 is advanced with respect to syringe holding member 206 as the use state, vent 241*b* overlaps communication hole 231*b*.

With such a configuration, when connection device 201 is caused to enter the use state by an operation identical to that in connection device 1 in accordance with the first embodiment, the solution inside the syringe is drawn into the vial by a pressure difference, because the inside of the vial is maintained under a vacuum.

On this occasion, since cannula holding member 207 is advanced with respect to syringe holding member 206 and vent 241*b* overlaps communication hole 231*b*, outside air is drawn from vent 241*b* into the vial through communication hole 231*b*, and the inside of the vial has ordinary pressure.

On this occasion, the drawn air passes through filter 246, and dust, microorganisms, and the like in the air are caught by filter 246 to prevent entry thereof into the vial.

When the medicament is prepared inside the vial and thereafter the plunger of the syringe is retracted to draw the medicament into the syringe, the plunger can be retracted with no resistance, because air is supplied into the vial through vent 241*b* and thus the inside of vial does not have a negative pressure.

It is to be noted that vent 241*b* and the configuration related thereto in the third embodiment are also applicable to connection device 101 in the second embodiment.

INDUSTRIAL APPLICABILITY

In the present invention, in the pre-use state, the separation preventing means prevents the syringe from being separated from the syringe holding member, as described above. Thereby, the connection device can prevent a user from forgetting to perform an operation of establishing communication between the syringe and the vial, and thus can be suitably used for medical care.

REFERENCE SIGNS LIST

1: connection device, 2: syringe, 3: vial, 4: holding means, 5: double-head cannula, 6: syringe holding member, 7: cannula holding member, 12: connection portion, 12*c*: external thread portion, 12*d*: groove, 32: attachment portion, 32*a*: internal thread portion, 32*b*: groove, 42: separation preventing means, 42*b*: partial thread portion, 45: holding protrusion.

The invention claimed is:

1. A connection device, comprising:

holding means spacing a syringe and a vial from each other or bringing the syringe and the vial close to each other; and a double-head cannula provided between lid members attached to the syringe and the vial for penetrating the lid members, wherein:

the connection device is configured to switch from a pre-use state in which the holding means spaces the syringe and the vial from each other and the double-head cannula does not penetrate the lid members of the syringe and the vial, to a use state in which the holding means brings the syringe and the vial close to each other and the double-head cannula penetrates the lid members of the syringe and the vial to establish communication between internal spaces of the syringe and the vial, the holding means is composed of a syringe holding member to be attached to the syringe, and a cannula holding member which includes the double-head cannula, is located at a retracted position retracted with resect to the syringe holding member in the pre-use state, and is advanced to an advanced position abutting on the syringe holding member in the use state, the connection device further comprises separation preventing means which engages the syringe to prevent separation of the syringe from the syringe holding member when the cannula holding member is located at the retracted position, and releases an engagement state with the syringe to permit the separation of the syringe from the syringe holding member when the cannula holding member is located at the advanced position, the syringe holding member and the syringe are connected by screwing, and the separation preventing means is provided to the cannula holding member, and when the cannula holding member is located at the retracted position in the pre-use state, the separation preventing means engages the syringe to prevent rotation of the syringe and the syringe holding member, and when the cannula holding member is located at the advanced position in the use state, the separation preventing means releases the engagement state to permit the rotation of the syringe and the syringe holding member.

2. The connection device according to claim 1, wherein an external thread portion is formed in the syringe, and an internal thread portion into which the external thread portion is to be screwed is formed in the syringe holding member, grooves are formed in the external thread portion and the internal thread portion, respectively, in a direction in which the syringe and cannula holding members are advanced and retracted, and the grooves are provided at positions where the grooves will overlap when the external thread portion is screwed into the internal thread portion, the separation preventing means is composed of an insertion piece provided to the cannula holding member for being advanced and retracted along the groove of the syringe holding member, and a partial thread portion protruding from the insertion piece toward the syringe, in the pre-use state, the partial thread portion is located at a position misaligned with respect to a helical shape of the internal thread portion, and engages the external thread portion to prevent the rotation of the syringe and the syringe holding member, and in the use state, the partial thread portion is aligned with the helical shape of the internal thread portion, and releases an engagement state between the partial thread portion and the external thread portion to permit the rotation of the syringe and the syringe holding member.

3. The connection device according to claim 2, wherein the cannula holding member is provided to be movable to a second retracted position which is more retracted with respect to the syringe holding member than the retracted position, and when the connection device is attached to the syringe, the cannula holding member is located at the second retracted position, and the partial thread portion in the separation preventing means is located at a position retracted toward the vial from the internal thread portion of the syringe holding member, to permit the rotation of the syringe and the syringe holding member.

4. The connection device according to claim 2, wherein a large diameter portion is formed in the lid member of the syringe, and a stopper member protruding toward a center is provided to the insertion piece at a position closer to the vial than the partial thread portion, and in a post-use state, the stopper member engages the large diameter portion of the lid member from a side closer to the syringe.

5. The connection device according to claim 1, wherein a cylindrical portion is formed at a tip end of the syringe and an internal thread portion is formed inside the cylindrical portion, and an external thread portion to be inserted into the cylindrical portion and screwed into the internal thread portion on an outside is formed in the syringe holding member, an engagement groove is formed on an outer surface of the cylindrical portion of the syringe, and the syringe holding member and the cannula holding member are made unrotatable with respect to each other, the separation preventing means is composed of a deformation member which is provided to the cannula holding member and located more outside than the cylindrical portion, and an engaging protrusion which is provided to the deformation member and can engage the engagement groove, in the pre-use state, the engaging protrusion engages the engagement groove to prevent integral rotation of the syringe holding member and the cannula holding member with respect to the syringe, and when the cannula holding member is located at the advanced position in the use state, the engaging protrusion is advanced and separated from the engagement groove while deforming the deformation portion to permit the integral rotation of the syringe holding member and the cannula holding member with respect to the syringe.

6. The connection device according to claim 5, wherein the cannula holding member is provided to be movable to a second retracted position which is more retracted with respect to the syringe holding member than the retracted position, and when the connection device is attached to the syringe, the cannula holding member is located at the second retracted position, and the engaging protrusion in the separation preventing means is located at a position retracted toward the vial from the engagement groove in the syringe holding member, to permit the rotation of the syringe and the syringe holding member.

7. The connection device according to claim 5, wherein a support portion formed to come into contact with a further outer periphery of the deformation portion of the cannula holding member is provided to the syringe holding member, in the pre-use state, the support portion is in close contact with the deformation portion to a position of the engaging protrusion, and prevents deformation of the deformation portion to prevent separation of the engaging protrusion from the engagement groove in the syringe, and in the use state, the engaging protrusion is advanced, separated from the engagement groove in the syringe, and moves to an outer peripheral side, and the support portion permits deformation of the deformation portion due to movement of the engaging protrusion.

8. The connection device according to claim 1, wherein the cannula holding member is provided with a plurality of flaps provided to surround the vial, and holding protrusions protruding on inner sides of the flaps, and in the pre-use state, an end surface of the vial on a side closer to the syringe abuts on back ends of the holding protrusions, and in the use state, the vial passes over the holding protrusions while deforming the flaps, and the holding protrusions engage a flange formed in the vial to hold the vial.

9. A connection device for connecting a syringe and a vial, comprising: a holder including a syringe holder to be attached to the syringe and a cannula holder which includes a double-head cannula and is to be attached to the vial; and a separation preventing mechanism, wherein:

the connection device is configured to switch from a pre-use state in which the holder spaces the syringe and the vial from each other and the double-head cannula does not penetrate lids of the syringe and the vial, to a use state in which the holder brings the syringe and the vial close to each other and the double-head cannula penetrates the lids of the syringe and the vial to establish communication between internal spaces of the syringe and the vial, the cannula holder is configured to be located at a retracted position retracted with respect to the syringe holder in the pre-use state, and to advance to an advanced position abutting on the syringe holder in the use state, and the separation preventing mechanism is configure to engage the syringe to prevent separation of the syringe from the syringe holder when the cannula holder is located at the retracted position, and to release an engagement state with the syringe to permit the separation of the syringe from the syringe holder when the cannula holder is located at the advanced position; and the separation preventing mechanism is provided to the cannula holder, and when the cannula holder is located at the retracted position in the pre-use state, the separation preventing mechanism engages the syringe to prevent rotation of the syringe and the syringe holder, and when the cannula holder is located at the advanced position in the use state, the separation preventing mechanism releases the engagement state to permit the rotation of the syringe and the syringe holder.

10. The connection device according to claim 9, wherein:

the syringe holder includes an internal thread into which an external thread of the syringe is to be screwed and a groove formed in a direction in which the syringe holder and the cannula holder are advanced and retracted, the groove being provided such a position that the groove overlaps a groove of the syringe when the external thread of the syringe is screwed into the internal thread of the syringe holder, the separation preventing mechanism includes an insertion piece provided to the cannula holder for being advanced and retracted along the groove of the syringe holder, and a partial thread portion protruding from the insertion piece, in the pre-use state, the partial thread portion is located at a position misaligned with respect to a helical shape of the internal thread, and is configured to engage the external thread portion to prevent the rotation of the syringe and the syringe holder, and in the use state, the partial thread portion is aligned with the helical shape of the internal thread, and releases an engagement state between the partial thread portion and the external thread to permit the rotation of the syringe and the syringe holder.

11. The connection device according to claim 10, wherein:

the cannula holder is configured to be movable to a second retracted position which is more retracted with respect to the syringe holder than the retracted position, and when the connection device is attached to the syringe, the cannula holder is configured to be located at the second retracted position, and the partial thread portion in the separation preventing mechanism is configured to be located at a position retracted toward the vial from the internal thread of the syringe holder, to permit the rotation of the syringe and the syringe holder.

12. The connection device according to claim 10, wherein:

a large diameter portion is formed in the lid of the syringe, and a stopper protruding toward a center is provided to the insertion piece at a position closer to the vial than the partial thread portion, and in a post-use state, the stopper engages the large diameter portion from a side closer to the syringe.

13. The connection device according to claim 9, wherein:

the syringe holder includes an external thread to be inserted into a cylindrical portion formed at a tip end of the syringe and to be screwed into an internal thread formed inside the cylindrical portion, the syringe holder and the cannula holder are made unrotatable with respect to each other, the separation preventing mechanism includes a deformation member which is provided to the cannula holder and located more outside than the cylindrical portion, and an engaging protrusion which is provided to the deformation member and can engage an engagement groove formed on an outer surface of the cylindrical portion of the syringe, in the pre-use state, the engaging protrusion is configured to engage the engagement groove to prevent integral rotation of the syringe holder and the cannula holder with respect to the syringe, and when the cannula holder is located at the advanced position in the use state, the engaging protrusion is configured to be advanced and separated from the engagement groove while deforming the deformation portion to permit the integral rotation of the syringe holder and the cannula holder with respect to the syringe.

14. The connection device according to claim 13, wherein:

the cannula holder is configured to be movable to a second retracted position which is more retracted with respect to the syringe holder than the retracted position, and when the connection device is attached to the syringe, the cannula holder is configured to be located at the second retracted position, and the engaging protrusion in the separation preventing mechanism is configured to be located at a position retracted toward the vial from the engagement groove in the syringe holder, to permit the rotation of the syringe and the syringe holder.

15. The connection device according to claim 13, wherein:

the syringe holder includes a support portion formed to come into contact with a further outer periphery of the deformation portion of the cannula holder, in the pre-use state, the support portion is configured to be in close contact with the deformation portion to a position of the engaging protrusion, and prevents deformation of the deformation portion to prevent separation of the engaging protrusion from the engagement groove in the syringe, and in the use state, the engaging protrusion is configured to be advanced, separated from the engagement groove in the syringe, and move to an outer peripheral side, and the support portion is configured to permit deformation of the deformation portion due to movement of the engaging protrusion.

16. The connection device according to claim 9, wherein the cannula holder is provided with a plurality of flaps, and holding protrusions protruding on inner sides of the flaps, and the connection device is configured such that in the pre-use state, an end surface of the vial on a side closer to the syringe abuts on back ends of the holding protrusions, and in the use state, the vial passes over the holding protrusions while deforming the flaps, and the holding protrusions engage a flange formed in the vial to hold the vial.

* * * * *